United States Patent [19]

Spinelli

[11] Patent Number: 4,537,395

[45] Date of Patent: Aug. 27, 1985

[54] EXERCISE DEVICE

[76] Inventor: Gene A. Spinelli, 1541 Circle La., Newman, Calif. 95360

[21] Appl. No.: 547,846

[22] Filed: Nov. 2, 1983

[51] Int. Cl.[3] ..... A63B 13/00

[52] U.S. Cl. ..... 272/123; 272/62; 272/70.3; 272/93; 272/109; 272/144

[58] Field of Search ..... 272/123, 93, 134, 136, 272/144, 62, 63, 109, 113, 70.3; D21/193

[56] References Cited

U.S. PATENT DOCUMENTS

| | | | |
|---|---|---|---|
| 2,405,024 | 7/1946 | Eynon | 272/134 X |
| 3,205,883 | 3/1963 | Stroop . | |
| 3,708,167 | 1/1973 | Potgieter | 272/134 X |
| 3,709,487 | 1/1973 | Walker | 272/63 X |
| 3,739,793 | 6/1973 | Wilson . | |
| 3,920,240 | 11/1975 | Ross . | |
| 4,072,309 | 2/1978 | Wilson | 272/136 |
| 4,094,331 | 6/1978 | Rozsa . | |
| 4,098,502 | 7/1978 | Faust . | |
| 4,319,747 | 3/1982 | Rogers . | |
| 4,337,942 | 7/1982 | Sidlinger et al. | 272/144 |
| 4,423,865 | 1/1984 | Mahnke | 272/123 |

*Primary Examiner*—Richard J. Apley

*Assistant Examiner*—Robert W. Bahr

*Attorney, Agent, or Firm*—Dennison, Meserole, Pollack & Scheiner

[57] ABSTRACT

An exercise device in the nature of a portable dip bar utilized in conjunction with an exercise bench. The device comprises an elongated base rod received within the upwardly directed saddles normally provided on a pair of laterally spaced uprights constituting a portion of the exercise bench support system. A sleeve is fixed centrally to the base rod and extends vertically thereabove and therebelow for the selective rigid combining therewith of a separable handle assembly and a separable stabilizer. The handle assembly includes a post telescopically received within the upper portion of the sleeve and a handle removably affixed to the upper end of the post, the handle including a pair of laterally directed spaced parallel gripping arms. The stabilizer includes an elongated stem, the upper end of which is telescopically received within the lower portion of the sleeve. The lower end of the stabilizer stem is rigid with a transverse cross member paralleling the base rod in spaced relation therebelow and engageable, as a stabilizing means, with the support uprights of the exercise bench.

12 Claims, 6 Drawing Figures

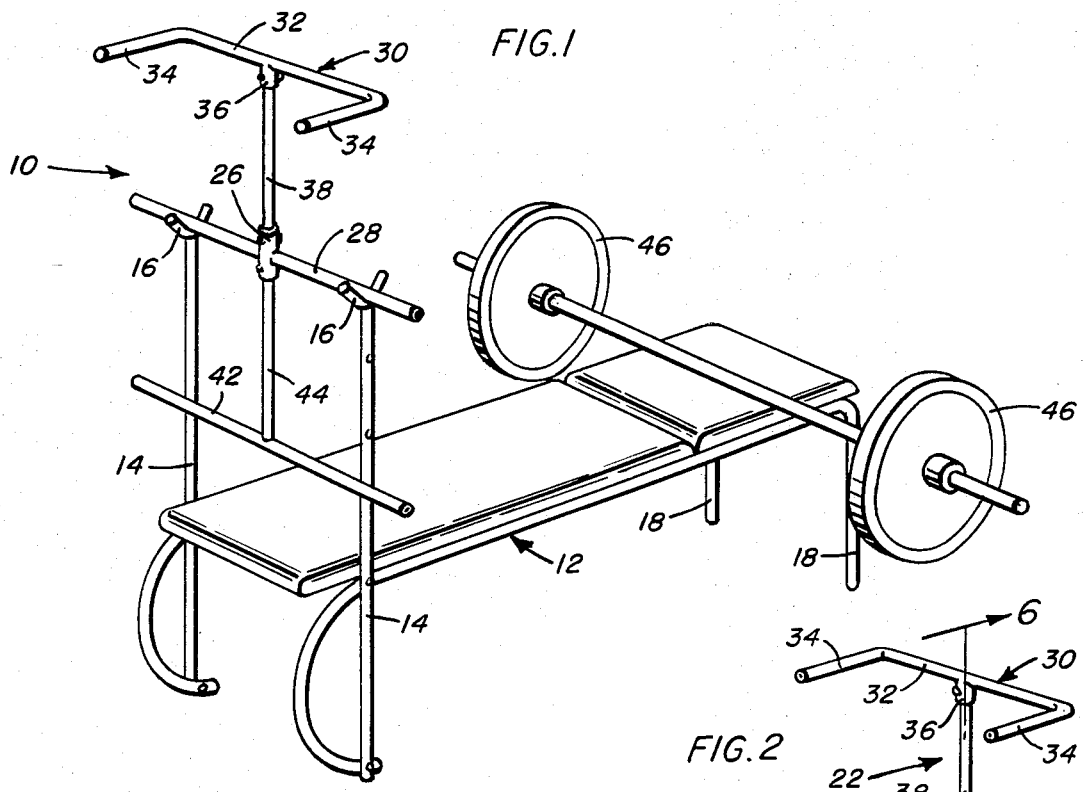
FIG. 1
10
12
14
16
18
26
28
30
32
34
36
38
42
44
46
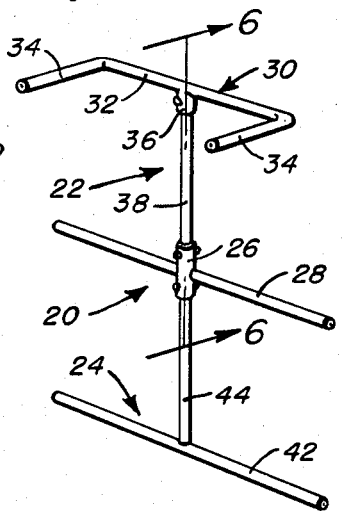
FIG. 2
6
20
22
24
26
28
30
32
34
36
38
42
44
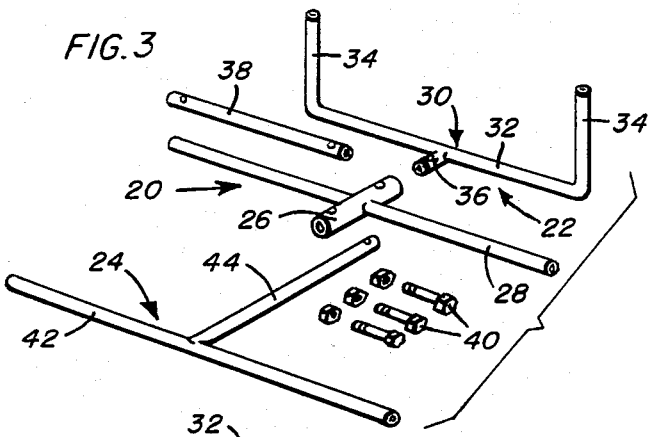
FIG. 3
20
22
24
26
28
30
32
34
36
38
40
42
44
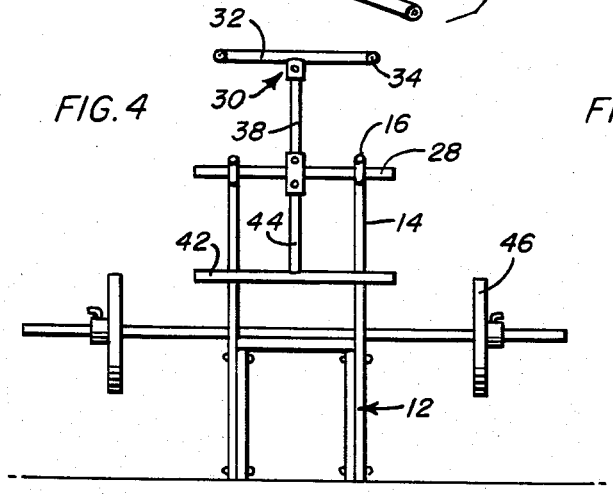
FIG. 4
12
14
16
28
30
32
34
38
42
44
46
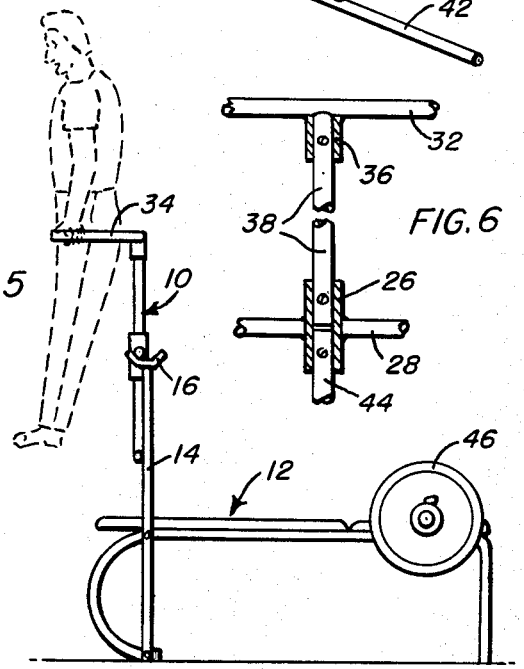
FIG. 5
10
12
14
16
34
46
FIG. 6
26
28
32
36
38
44

EXERCISE DEVICE

BACKGROUND OF THE INVENTION

The invention is generally concerned with excercise apparatus, and specifically relates to dip bars, that is exercise devices wherein the user is provided with a pair of laterally spaced hand grips at approximately chest level. The user, gripping the device, is able to perform a series of exercises through a selective raising and lowering of the body by extending and contracting the arms, accompanied by leg lifts if desired, which are considered an important adjunct to a full body development program. Such exercises are helpful in providing for increased strength and muscle development, particularly the tricep muscles of the arms, the pectoral muscles of the chest, and the various stomach muscles.

While dip bars of various types are presently available, the known devices normally require bolting to the walls and/or floor to effect the necessary stabilization thereof, particularly in light of the sustantial loads introduced. Such known devices, in many instances an integral portion of larger equipment, are both expensive and require substantial room for their installation. As such, dip bars are normally not considered a part of home exercise equipment, notwithstanding the significant advantages of such equipment and the preferance for use thereof by most body builders, weight trainers, power lifters and athletes.

SUMMARY OF THE INVENTION

The present invention proposes a unique portable dip bar construction which attaches, freely and without mechanical fasteners, to a conventional weight or exercise bench of the type commonly found in the home of or readily available to any person involved in weight lifting, whether for strength or muscular development, or both.

The portable dip bar or exercise device includes a base comprising an elongated main or base rod which seats directly in the normally provided laterally spaced upwardly directed saddles or hooks which, on a conventional exercise bench, selectively support barbells. The exercise device further includes a handle assembly including a post rigidly projecting upwardly from the base rod and having, rigid with the upper end thereof, a handle including laterally directed parallel spaced gripping arms. These arms are directed away from one end of the exercise bench for a full body raising, lowering and manipulating without interference from the bench. Finally, the exercise device is effectively stabilized by a stabilizer depending from the base and terminating in a cross member or rod which engages against the faces of the saddle-supporting uprights of the support structure of the bench for a stabilization of the dip bar and an effective resistance against any tendency for the exercise device to rotate about the saddle-supported base rod. The stabilizer rod, engaging with both exercise bench uprights, also tends to have a stabilizing effect on the uprights.

Inasmuch as the load introduced into the exercise device during use will normally be laterally outward of the exercise bench uprights, it will, as a practical matter, be desirable to stabilize the exercise bench against any tendency to displace or move during use of the dip bar. This is easily and effectively accomplished by merely placing an appropriately weighted barbell, for example 75 to 100 pounds, as a counterweight across the opposite or foot end of the exercise bench.

Inasmuch as the exercise device of the present invention is particularly, although not exclusively, adapted for use in the home environment or other relatively confined areas wherein a permanent installation is not desired or possible, it is also proposed that the device be capable of ready disassembly into several component parts for easy storage, transporting, or the like. Basically, the base rod includes a central sleeve which telescopically receives the posts or stems of the handle assembly and stabilizer which in turn are fixed therein by through-bolts or pins. Similarly, the U-shaped handle can also disengage from the associated post which extends between the handle and the base.

These and other objects and advantages residing in the details of construction and manner of use of the exercise device of the invention will become apparent as the invention is more fully hereinafter described and claimed.

BRIEF DESCRIPTION OF THE DRAWING

FIG. 1 is a perspective view of the device of the present invention is operable position on an exercise bench;

FIG. 2 is a perspective view of the dip bar itself;

FIG. 3 is a disassembled view of the dip bar;

FIG. 4 is a front view of the bench mounted bar;

FIG. 5 is a side view of the dip bar in use; and

FIG. 6 is a detail generally on line 6—6 of FIG. 5 and illustrating the connector means in cross-section.

DESCRIPTION OF PREFERRED EMBODIMENT

Referring now more specifically to the drawings, the exercise device or dip bar is generally designated by reference numeral 10. As noted in FIGS. 1, 4 and 5, the dip bar 10 is particularly intended for use with a conventional weight or exercise bench 12 as a support structure. The bench 12 normally incorporates a pair of uprights or standards 14 having weight receiving upwardly directed hooks or saddles 16 thereon. Such saddles, in the conventional use of the bench 12, selectively receive and support barbells. The uprights 14 usually constitute the legs of the bench 12 at one end thereof with appropriate relatively shorter legs 18 supporting the other or remote end of the bench.

The exercise device or dip bar 10 is considered to be portable because of its unique construction which is not only compact, but also enables a mounting of the device on substantially any conventional weight or exercise bench in a matter of seconds freely and without necessitating the use of any tools, mechanical interlocks, or the like. The removal of the exercise device is equally unencumbered and easily effected by merely an upward lifting of the device. The portability of the device 10 is enhanced by a preferred knock-down construction which, through connector means, allows for a compacting of the device for both storage and transporting purposes.

Referring now to the specific construction of the dip bar 10, this device includes a central base 20, a handle assembly 22 upward of the base 20, and a stabilizer 24 below the base.

The base 20 comprises a central vertically elongated sleeve 26 defining, respectively at the upper and lower ends thereof, upwardly and downwardly directed sockets. Rigid with the sleeve 26 and extending transversely thereacross, for horizontal positioning in the in-use position of the dip bar 10, is an elongated rigid base rod or tube 28. This member 28, as illustrated, can actually consist of two lengths aligned to opposed points on the central sleeve 26 with the inner ends thereof rigidly affixed to the sleeve as by welding. Alternatively, the base rod 28 can be of a single length extended tangentially across the sleeve, to one side thereof, or centrally through the sleeve with the sockets to the opposite sides thereof. In each case, the rod 28 and sleeve 26 are welded or otherwise rigidly affixed.

The handle assembly 22 includes a handle 30 comprising a cross-member 32 of a shorter length than the base rod 28 and adapted to extend parallel to this base rod 28 in vertically spaced position thereabove. The handle 30 also includes a pair of parallel spaced arms 34 integral or otherwise rigidly engaged with the opposed ends of the handle cross-member 32 and projecting laterally therefrom toward one side of the exercise device 10. These arms 34 are to be so spaced as to allow for the accommodation of a user's body therebetween while comfortably gripping the handle arms 34 as suggested in FIG. 5. The handle is completed by a depending sleeve 36 extending centrally from the cross-member 32 and defining a downwardly opening socket.

The handle 30 is assembled rigid with the base 20 by an elongated support or post 38, preferably in the nature of a tube or rod. This post 38 has upper and lower end portions respectively received within the handle sleeve 36 and the upwardly directed socket defined by the base sleeve 26. It is contemplated that the telescopic engagement be provided under relatively close tolerance to avoid any looseness or tendency for shifting. In each instance, the end portion of the post 38 is locked within the respective sleeve socket by an appropriate retaining pin 40 which may be in the nature of an elongated headed bolt with an associated end nut threaded thereon subsequent to introduction through aligned holes in each sleeve and post end.

The stabilizer 24 is basically an inverted T-shaped unit including a tubular or rod-like cross-member 42 positioned in vertically spaced parallel relation below base rod 28. This stabilizer member 42 will preferably be of a length generally equal to that of the base rod 28 for engagement with the bench uprights 14 as the base rod 28 is supported within the weight saddles 16, all as shall be explained in more detail subsequently. The stabilizer 24 is completed by an upwardly extending elongated stem or leg 44 rigidly welded or otherwise affixed to a central point along the cross-member 42. This stem 44 will preferably be of tubular or rod-like construction and has an upper end portion adapted for close-tolerance telescopic reception within the downwardly directed socket defined by the base sleeve 26. The socket received upper portion of the stem 44 is, similar to the other socket received members, releasably pinned or bolted in rigid confinement within the socket. If deemed desirable, for additional stability, the lower end portion of the post 38 of the handle assembly and the upper end portion of the stem 44 of the stabilizer can engage within the base sleeve 26. It is to be appreciated that the positioning of the holes which receive the assemblying pins or bolts 40 is such as to provide for, in the assembled device, the desired parallel relationship between the base member 28, the cross-member 32 of the handle thereabove, and the cross-member 42 of the stabilizer therebelow. When assembled, the base member 28, handle cross-member 32 and stabilizer cross-member 42 are in substantially a common plane. If desired, appropriate end caps can be provided over the exposed ends of the several members. Similarly, hand grips may be provided on the laterally directed user engaging arms 34.

In mounting the dip bar 10, it is positioned in operative cooperation with a weight or exercise bench by merely downwardly seating the base rod or cross-member 28 in the laterally spaced upwardly directed support saddles 16 with the gripping arms 34 extending longitudinally beyond the end of the bench for free access thereto, and with the cross-member 42 of the stabilizer extending across and engaging the outer faces of the two saddle supporting standards 14 of the bench 12. As will be readily appreciated from the drawings, the engagement of the stabilizer cross-member 42 with the uprights or standards 14 is to the same side thereof as the projection of the handle arms 34 whereby any tendency for the device 10 to rotate about the saddle-supported base member 28 will be directly resisted by engagement of the stabilizer member 42 with the uprights 14. It will be recognized that the mounting of the device 10 on the weight bench 12 involves only a matter of a few seconds, the time involved in properly orienting the device 10 and freely seating the base member 28 in the saddles 16. Removal of the device 10 is similarly unencumbered and quickly effected by merely a raising thereof to lift the base member 28 from the saddles 16.

The significance of the stabilizer extends beyond its general function in preventing rotation of the exercise device. Engagement of the stabilizer cross-member 42 with both uprights along the central portion of the normally unsupported height thereof above the bench tends to brace and stabilize the uprights themselves, removing any tendency for the uprights to vibrate or otherwise move upon the introduction of the slightly offcenter load of the user manipulating his own weight through engagement with the handle arms 34.

It is believed that the general use of the bench mounted device will be readily apparent from the drawings, and in particular FIG. 5. As will normally be the case, and as suggested in FIGS. 1 and 5, the exercise bench 12 itself will be counterweighted, at the remote end from the standards 14, in any appropriate manner and to counteract the weight introduced immediately beyond the near end of the bench by use of the exercise apparatus 10. Such a counterweighting can easily be provided using barbells 44 or similar readily available weight equipment.

I claim:

1. An exercise device particularly adapted for use in conjunction with exercise apparatus including a pair of spaced upwardly opening support saddles to which the exercise device is freely introduced, and a stable structure below the saddles for free abutment of the exercise device thereagainst; said exercise device comprising an elongated base member adapted for free reception in spaced upwardly opening support saddles, a support comprising an elongated post including a lower end rigid with said base member at an intermediate point therealong, said support post projecting vertically upward from said base member and terminating at an upper end, a handle, said handle comprising a cross-member fixed to the upper end of the support post, said cross-member generally paralleling said base member and terminating in opposed ends, said handle further including gripping arms rigid with said opposed ends of said cross-member and projecting laterally of said cross-member in spaced parallel relation to each other, and a stabilizer, said stabilizer comprising an elongated stem rigid with said base member at an intermediate point therealong and terminating in a lower end, said stabilizer further including a cross-member fixed to the lower end of the stem and extending parallel to said base member generally coextensive therewith, and in vertically spaced relation therebelow for free engagement against a stable structure, said base member, support, handle cross-member and stabilizer defining a common plane, said gripping arms projecting laterally of said plane.

2. The exercise device of claim 1 including connector means releasably interconnecting said base member, handle and stabilizer for a selective disassembly of the device.

3. The exercise device of claim 2 wherein said connector means comprises an elongated connector member rigid with said base member and positioned transversely thereacross, said connector member defining a pair of oppositely directed end portions respectively telescopically and releasably receiving adjoining portions of the support post and the stabilizer stem, and lock means releasably interlocking the telescopically received portions.

4. The exercise device of claim 3 wherein said connector member comprises an elongated sleeve with the opposite end portions thereof defining sockets.

5. The exercise device of claim 4 wherein said connector means includes a connector depending centrally from the handle cross-member and telescopically and releasably receiving the upper end of the support post, and lock means releasably interlocking the handle connector and the upper end of the support post.

6. In exercising apparatus utilizing a weight bench including a pair of vertical laterally spaced standards, each standard mounting an upwardly directed support saddle thereon, said saddles being transversely aligned to receive a barbell or the like; the improvement comprising a dip bar including an elongated base member freely lowerable into supported seating engagement in said saddles and freely upwardly removeable therefrom, said base member, when seated in said saddles, extending across and between said saddles, a support having a lower portion rigid with said base member, said support projecting vertically upward from said base member and terminating in an upper end portion, a handle including a cross-member paralleling said base member and fixed to the upper end of said support post, said handle further including a pair of gripping arms fixed to and extending laterally from said cross-member, said arms being in spaced parallel relation to each other, and a stabilizer rigid with and depending from said base bar, said stabilizer including a lower portion thereof paralleling said base bar and positionable transversely across the spaced standards of the weight bench to one side thereof and engageable thereagainst to preclude rotation of the dip bar upon introduction to a load to the gripping arms.

7. The improvement of claim 1 wherein said stabilizer further includes a depending stem aligned with the support post, said stem having an upper end portion rigid with said base member, and a lower end portion, the standard-engaging portion of said stabilizer being rigid with the lower end portion of said stem and comprising an elongated rod-like member.

8. The improvement of claim 7 including means releasably and selectively rigidly interconnecting said base member, said stabilizer stem, said support post, and said handle.

9. The improvement of claim 7, wherein said handle cross member, said base member, and said stabilizer are in substantially a common plane, said gripping arms comprising the sole components of said dip bar extending laterally of said common plane.

10. An exercise device including a pair of upwardly directed support saddles fixedly mounted on a support structure in laterally spaced relation to each other, a dip bar, said dip bar comprising an elongated base member freely seated within the support saddles for unencumbered upward removal therefrom, a vertical post rigid with said base member at an intermediate point therealong, said post terminating in an upper end, a cross-member fixed to the upper end of said post, a pair of spaced parallel gripping arms, rigid with said cross-member and projecting laterally therefrom, and a stabilizer rigid with said base bar and depending therebelow, said stabilizer including a lower portion for engagement with the support structure below the support saddles.

11. The construction of claim 10 wherein said base member and said lower portion of said stabilizer comprise parallel and generally coextensive elongated rod-like members.

12. The construction of claim 11 including means releasably interconnecting said base member, stabilizer, support post and handle for a selective disassembly thereof.

* * * * *

UNITED STATES PATENT AND TRADEMARK OFFICE

CERTIFICATE OF CORRECTION

PATENT NO. : 4,537,395

DATED : August 27, 1985

INVENTOR(S) : Gene A. Spinelli

It is certified that error appears in the above-identified patent and that said Letters Patent are hereby corrected as shown below:

Column 5, claim 6, line 43, after "support" insert -- post --
line 45, after "support" insert -- post --.

Column 6, claim 7, line 10, "claim 1" should be "claim 6" - i.e., Claim 7 should depend from Claim 6.

Signed and Sealed this

*Seventh* Day of *January 1986*

[SEAL]

*Attest:*

DONALD J. QUIGG

*Attesting Officer*

*Commissioner of Patents and Trademarks*